US007711303B2

(12) United States Patent
Jeong

(10) Patent No.: US 7,711,303 B2
(45) Date of Patent: May 4, 2010

(54) VARIABLE TENSION BELT TYPE FUSING UNIT USABLE WITH IMAGE FORMING APPARATUS AND DRIVING METHOD THEREOF

(75) Inventor: Jae-hyeuk Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 931 days.

(21) Appl. No.: 11/475,180

(22) Filed: Jun. 27, 2006

(65) Prior Publication Data

US 2007/0071521 A1 Mar. 29, 2007

(30) Foreign Application Priority Data

Jul. 15, 2005 (KR) ..... 10-2005-0064180

(51) Int. Cl.
*G03G 15/20* (2006.01)

(52) U.S. Cl. ..... 399/329

(58) Field of Classification Search ..... 399/33, 399/122, 330, 338, 329, 328
See application file for complete search history.

(56) References Cited

U.S. PATENT DOCUMENTS

2002/0018676 A1* 2/2002 Hirai et al. ..... 399/329
2005/0047838 A1* 3/2005 Uehara et al. ..... 399/329
2005/0117942 A1* 6/2005 Ishii et al. ..... 399/328

FOREIGN PATENT DOCUMENTS

| | | |
|---|---|---|
| JP | 07-199676 | 8/1995 |
| JP | 11-352790 | 12/1999 |
| JP | 2000-038232 | 2/2000 |
| JP | 2001-022188 | 1/2001 |
| JP | 2003-091174 | 3/2003 |
| JP | 2004-109385 | 4/2004 |

* cited by examiner

*Primary Examiner*—David M Gray
*Assistant Examiner*—Billy J Lactaoen
(74) *Attorney, Agent, or Firm*—Stanzione & Kim LLP

(57) ABSTRACT

A variable tension type belt fusing unit includes a main roller, a pair of belt driving rollers which is disposed near the outer circumferential surface of the main roller and is pressurized towards the main roller, and a fusing belt having a nip portion and a non-tension portion. At least one of the pair of belt driving rollers is independently and temporarily driven to apply or release a tension to the nip portion. In a driving method of the variable tension type belt fusing unit, the tension is applied to the nip portion of the fusing belt when the variable tension type belt fusing unit is prepared for an operation, the fusing belt travels while maintaining the tension during the operation of the variable tension type belt fusing unit, and the tension is released when the operation is completed.

21 Claims, 6 Drawing Sheets

VARIABLE TENSION BELT TYPE FUSING UNIT USABLE WITH IMAGE FORMING APPARATUS AND DRIVING METHOD THEREOF

CROSS-REFERENCE TO RELATED APPLICATIONS

This application claims the benefit under 35 U.S.C. § 119 of Korean Patent Application No. 2005-64180, filed on Jul. 15, 2005, in the Korean Intellectual Property Office, the disclosure of which is incorporated herein in its entirety by reference.

BACKGROUND OF THE INVENTION

1. Field of the Invention

The present general inventive concept relates to a fusing unit usable with an electrophotographic image forming apparatus which fuses an image onto a recording medium, such as a paper, in which a toner image is transferred, by applying heat and pressure, and more particularly, to a belt type fusing unit which includes a main roller and a fusing belt to rotate in contact with a portion of an outer circumferential surface of the main roller, wherein the fusing belt has a tension portion and a non-tension portion.

2. Description of the Related Art

Common image forming apparatuses, such as a laser beam printer, an LED printer, a digital copy machine, and a facsimile, transfer an image onto a paper as a visible image in response to a digital signal input from a computer or a scanner.

Electrophotographic image forming apparatuses form an electrostatic latent image corresponding to a desired image onto an outer circumferential surface of a photoconductor by exposing light to the outer circumferential surface of the photoconductor in response to a digital signal corresponding to the desired image to be printed using a predetermined pattern, develop the electrostatic latent image using a power type toner, transfer the developed image onto a paper directly or via a transfer medium, and perform a fusing process thereon.

As mentioned above, the electrophotographic image forming apparatus includes a fusing unit which fuses a toner image (i.e., the developed image) transferred onto the paper by applying heat and pressure. A conventional fusing unit used in the electrophotographic image forming apparatus includes a roller type fusing unit and a belt type fusing unit. Compared to the roller type fusing unit, the belt type fusing unit can ensure a long nip section, so that a fusing temperature can be lowered. In addition, since a belt having a small heat capacity is used, a heat transfer efficiency can be improved.

In the belt type fusing unit, the belt is pressurized towards a main roller to apply a tension to the belt. Since the belt is made of a material having a form of a thin film and is continuously subjected to a tension stress in a high temperature environment, deformation of the belt frequently occurs. In addition, a lifespan of the belt is severely reduced due to the high temperature environment and the tension. Additionally, if slipping or meandering occurs when a predetermined tension is applied, it is difficult to control the applied tension or to fix the slipping or meandering.

SUMMARY OF THE INVENTION

The present general inventive concept provides a variable tension belt type fusing unit in which a fusing belt is divided into a tension portion having a nip section required to fuse a toner image and a non-tension portion, wherein a tension is applied to the fusing belt only within the tension portion, and the tension of the tension portion is released during a power saving mode, thereby increasing a lifespan of the fusing belt and improving a stability of the fusing belt traveling, and a driving method thereof.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a variable tension type belt fusing unit including a main roller, a pair of belt driving rollers which is disposed near an outer circumferential surface of the main roller and is disposed towards the main roller, and a fusing belt to travel by the pair of belt driving rollers in a travel direction and having a nip portion and a non-tension portion, the nip portion being biased or pressurized towards the main roller by applying a tension and disposed at one side of the pair of belt driving rollers and the non-tension portion being provided at the other side of the pair of belt driving rollers such that at least one of the pair of belt driving rollers being independently and temporarily driven to apply or release the tension to the nip portion.

The at least one of the pair of belt driving rollers may temporarily and relatively rotate in the traveling direction with respect to the main roller to apply or release the tension in the nip portion .

The pair of belt driving rollers comprises a preceding roller to temporarily and reversely rotate with respect to the main roller.

The pair of belt driving rollers may temporarily rotate in opposite directions to release the tension from the nip portion.

At least one of the pair of belt driving rollers temporarily may move in a direction that narrows a distance between the pair of belt driving rollers.

The variable tension type belt fusing unit may further comprise a pinch roller engaged with one of the pair of belt driving rollers to drive the fusing belt.

The foregoing and/or other aspects of the present general inventive concept may also be achieved by providing a driving method of a variable tension type belt fusing unit including a main roller, a pair of belt driving rollers which is disposed near an outer circumferential surface of the main roller and is pressurized towards the main roller, and a fusing belt to travel between the pair of belt driving rollers and the main roller, the method comprising applying a tension to a nip portion of the fusing belt by the pair of belt driving rollers in a printing mode, maintaining the tension in the nip portion during the printing mode, while the fusing belt travels, and releasing the tension in the nip portion by the pair of belt driving rollers when the printing mode is completed or a stand-by mode.

The applying of the tension may comprise rotating independently at least one roller of the pair of belt driving rollers in a direction away from the nip portion in the printing mode, the maintaining of the tension may comprise rotating the main roller and the pair of belt driving rollers to be engaged with each other to have a same travel speed at each surface facing each other during the printing mode, and the releasing of the tension may comprise rotating independently at least one of the pair of belt driving rollers towards the nip portion when the printing mode is completed.

The applying of the tension and the releasing of the tension may comprise rotating independently only a preceding roller of the pair of belt driving rollers when the variable tension type belt fusing unit is in the printing mode and the stand-by mode, respectively.

The applying of the tension and the releasing of the tension may comprise simultaneously rotating the pair of belt driving rollers in opposite directions in the stand-by mode.

The applying of the tension may comprise independently moving at least one of the pair of belt driving rollers in a direction that widens a distance between the pair of belt driving rollers when the variable tension type belt fusing unit is in the printing mode, the maintaining of the tension may comprise rotating the main roller and the pair of belt driving rollers engaged with each other to have the same travel speed at each surface facing each other during the printing mode, and the releasing of the tension comprises moving at least one roller of the pair of belt driving rollers in a direction that narrows the distance between the pair of belt driving rollers when the printing mode is terminated.

The foregoing and/or other aspects of the present general inventive concept may also be achieved by providing an image forming apparatus, comprising a main roller, a fusing belt, and a pair of belt driving rollers disposed inside the fusing belt to rotate the fusing belt to form a nip portion of the fusing belt between the pair of the belt driving rollers to face a portion of the main roller, one of the pair of belt driving rollers moving according to first and second manners with respect to the other one of the belt driving rollers such that tension is applied to or released from a nip portion of the fusing belt.

The foregoing and/or other aspects of the present general inventive concept may also be achieved by providing an image forming apparatus, including a main roller, a pair of belt driving rollers, and a fusing belt having a nip portion disposed between the pair of the belt driving rollers and wound around a portion of the main roller and a non-nip portion disposed between the pair of belt driving belt and opposite to the main roller with respect to the nip portion, the nip portion having a first length in a printing mode and a second length longer than the first length in a stand-by mode according to a movement of one of the pair of the belt driving rollers with respect to the other one of the pair of the belt driving rollers.

The foregoing and/or other aspects of the present general inventive concept may also be achieved by providing an image forming apparatus, including a main roller, a pair of belt driving rollers, and a fusing belt having a nip portion disposed between the pair of the belt driving rollers and wound around a portion of the main roller, and a non-nip portion disposed between the pair of belt driving belt and opposite to the main roller with respect to the nip portion, the nip portion having a first length shorter than a distance between rotational axes of the pair of the belt driving rollers in a circumferential direction of the main roller in the printing mode to push a printing medium against the portion of the main roller, and a second length longer than the distance between the rotational axes of the pair of the belt driving rollers in a circumferential direction of the main roller in the printing mode to push a printing medium against the portion of the main roller.

The foregoing and/or other aspects of the present general inventive concept may also be achieved by providing an image forming apparatus, including a main roller, a pair of belt driving rollers, and a fusing belt having a nip portion disposed between the pair of the belt driving rollers and wound around a portion of the main roller and a non-nip portion disposed between the pair of belt driving belt and opposite to the main roller with respect to the nip portion, the nip portion having a length in a stand-by mode, and the length of the nip portion becoming shorter than the length according to a movement of at least one of the pair of belt driving rollers with respect to the other one of the pair of the belt driving rollers when the stand-by mode is changed to the printing mode.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
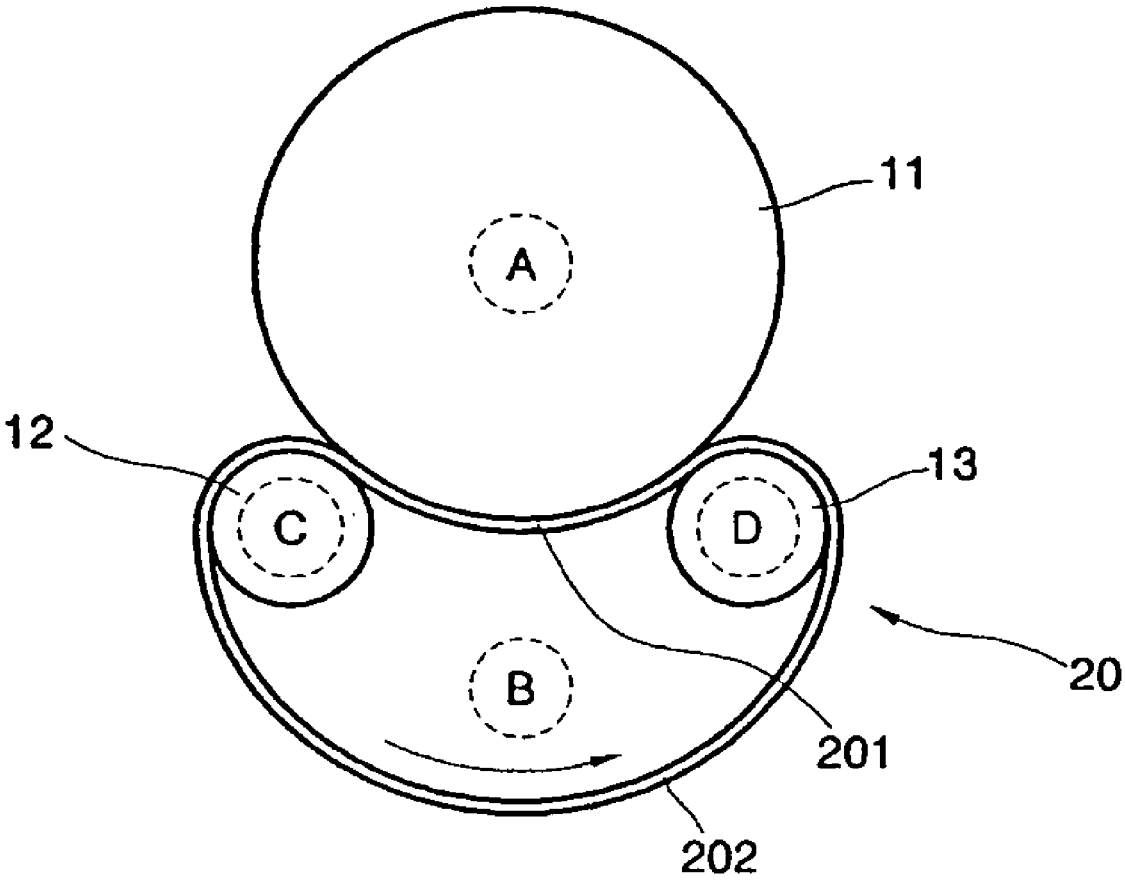
FIG. 1 is a schematic side view illustrating a variable tension belt type fusing unit according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic side view illustrating a variable tension belt type fusing unit according to an embodiment of the present general inventive concept. The variable type fusing unit may be usable with an image forming apparatus and may include a main roller 11 and a pair of belt driving rollers, such as a preceding roller 12 and an accompanying roller 13. The main roller 11 may have a relatively larger diameter than the pair of belt driving rollers.

A fusing belt 20 forming an infinite loop is wound around the preceding and accompanying rollers 12 and 13 which are respectively pressurized towards the main roller 11 by a predetermined pressure so that the fusing belt 20 is pushed against an outer circumferential surface of the main roller 11. The fusing belt 20 includes a nip portion 201 and a non-tension portion 202. The nip portion 201 is disposed around the main roller 11, and the non-tension portion 202 is disposed away from the main roller 11 with respect to the nip portion 201. If a tension is applied to the nip portion 201 of the fusing belt 20 between the two rollers 12 and 13, the nip portion 201 is adhered onto or disposed to be in contact with the outer circumferential surface of the main roller 11 due to the predetermined pressure according to a strength of the tension. The non-tension portion 202 loosely travels. Due to a force exerted on the fusing belt 20 and the main roller 11 by the belt driving rollers, a friction force is ensured between the pair of belt driving rollers and the fusing belt 20 such that the tension is applied to the nip portion 201.

A heat source of the variable tension belt type fusing unit to apply heat on a toner image may be provided in various forms, such as a halogen lamp, a resistance heating element, and an induction heating element. The heat source may be selectively disposed at a portion A in the main roller 11, a portion B in the loop of the fusing belt 20, a portion C in the preceding roller 12, or a portion D in the accompanying roller 13.

The variable tension belt type fusing unit of the present embodiment has a driving force transfer structure in which the main roller 11, the preceding roller 12, and the accompanying roller 13 can rotate together when the variable tension belt type fusing unit operates. In the driving force transfer structure (not shown), at least one of the preceding roller 12 and the accompanying roller 13 is independently and temporarily drivable. Here, a travel direction of the fusing belt 20 during the operation of the variable tension belt type fusing unit is considered as a reference of forward and reverse directions. The fusion belt 20 may rotate along a traveling direction as illustrated in FIG. 1. At least one of the preceding roller 12 and the accompanying roller 13 can be temporarily released from an engaging state with the main roller 11 to be independently driven. Accordingly, the preceding roller 12 independently rotates with respect to the accompanying roller 13 and/or the main roller 11, the preceding roller 12 and the accompanying roller 13 rotates in opposite directions while the main roller does not rotate, or the axis of the preceding roller 12 or the accompanying roller 13 may be moved, so that the tension is applied to and released from the nip portion 201 of the fusing belt 20.

The fusing belt 20 is made of a film material in a shape of a closed loop, and may be made of a laminated film, which is composed of a heat proof resin, a metal thin plate, or a plurality of layers, and the laminated film may include a metal layer. In order to reduce time for receiving a tension stress compared to a conventional belt type fusing unit in a high temperature environment, various materials can be selected.

The driving force transfer structure to temporary and independently drive a roller can be implemented by selecting and combining elements to transfer and to block a driving force to the roller. As an example, in one embodiment of the driving force transfer structure, the preceding roller 12 may be independently and temporarily driven by providing a clutch at a rotation axis of the preceding roller 12. The driving force transfer structure may be provided in various forms by selecting and combining elements to transfer the driving force.

Figure 2A:
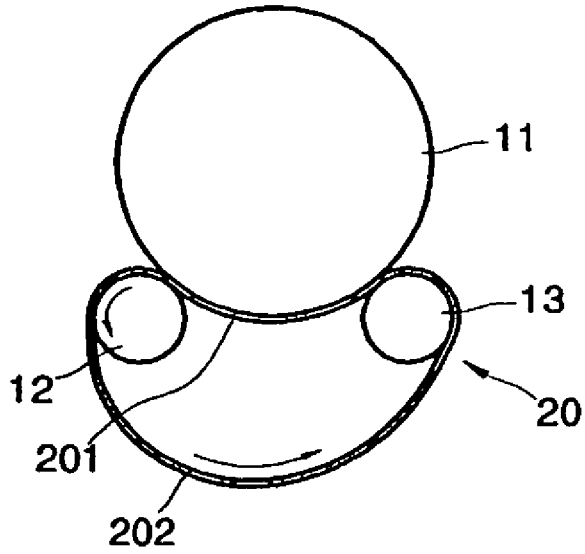
FIGS. 2A and 2B are views illustrating a driving method of the fusing unit of FIG. 1 according to an embodiment of the present general inventive concept.
Figure 2B:
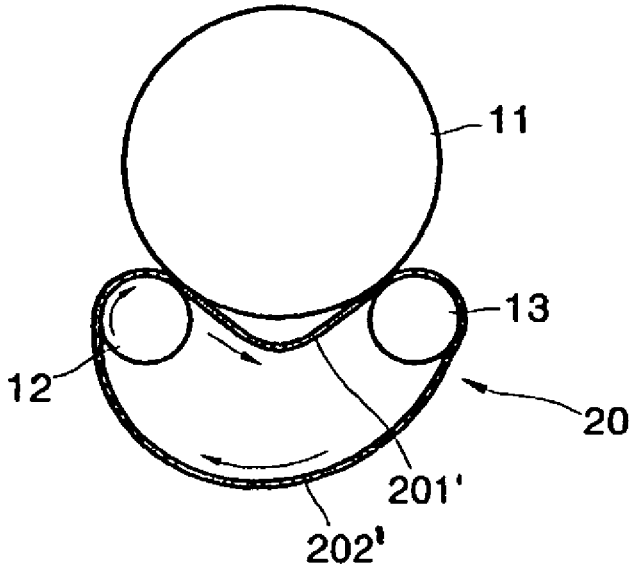

FIGS. 2A and 2B are views illustrating a driving method of the variable tension belt type fusing unit according to the first embodiment of FIG. 1. Like reference numerals as illustrated in FIG. 1 denote like elements or parts of FIGS. 2A and 2B, and identical descriptions may be omitted in order to avoid unnecessary repetition with respect to all drawings described hereinafter.

When the variable tension belt type fusing unit operates, the preceding roller 12 independently rotates in the forward direction corresponding to the traveling direction of the fusing belt 20 as shown in FIG. 2A. Since the accompanying roller 13 rotates according to a rotation of the preceding roller 12, the tension is applied to the nip portion 201.

In order to apply a proper tension to the nip portion 201, a proper amount of deformation may be determined based on a tension test for the fusing belt 20 and then the preceding roller 12 may be rotated to generate the tension, or the tension may be determined from a targeted pressure between the fusing belt 20 and the main roller 11 and then the preceding roller 12 may be rotated by a torque corresponding to the targeted pressure.

During the operation of the variable tension belt type fusing unit, the main roller 11 and the preceding and accompanying rollers 12 and 13 maintain the tension in the nip portion 201 while being engaged with each other to travel at the same speed at respective facing surfaces (or contact areas).

When the operation of the variable tension belt type fusing unit is completed, the preceding roller 12 independently rotates in the reverse direction as illustrated in FIG. 2B. That is, the preceding roller 12 reversely rotates and loosens the fusion belt 20 to form a non-nip portion 201'. The second nip portion 201' of FIG. 2B is longer than the nip portion 201 of FIG. 2A that is subjected to the tension, and a second non-tension portion 202' may be shorter than the non-tension portion 202 corresponding to the nip portion 201. When the tension in the nip portion 201 is released to show the non-nip portion 201' of FIG. 2B, the variable tension belt type fusing unit is in a power save mode (or a stand-by mode).

The nip portion and non-nip portion 201 and 201' include first portions disposed between the main roller 11 and the preceding roller 12 and the accompanying roller 13, respectively, and spaced apart from the main roller 11 by a first distance or in contact with the main roller 11, and a second portion between the first portions to be spaced from the main roller 11 by a second distance and a third distance according to a printing operation mode and a stand-by mode, respectively. The second portion is apart from the main roller 11 by the third distance greater than the second distance in the stand-by mode by a movement of at least one of the preceding roller 12 and the accompanying roller 13. That is, the preceding roller 12 moves or rotates in the forward direction with respect to the accompanying roller 13 in the printing mode, the tension is applied to the nip portion 201 of the fusing belt 20 to rotate the fusing belt 20 in the traveling direction, and the preceding roller 12 moves or rotates in the reverse direction with respect to the accompanying roller 13 in the stand-by mode or when the printing mode is completed, the tension is leased from the nip portion 201 of the fusing belt 20 to rotate a portion of the fusing belt 20 in a direction opposite to the traveling direction, so that the second non-nip portion 201' is formed.

Figure 3A:
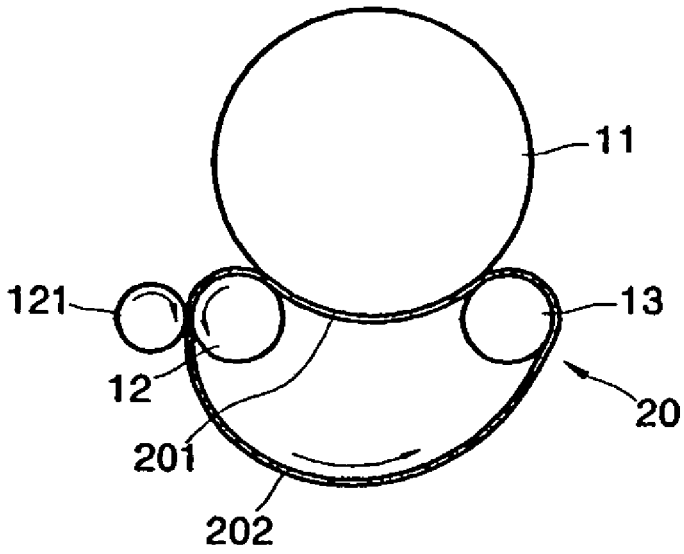
FIGS. 3A and 3B are views illustrating a driving method of a fusing unit according to another embodiment of the present general inventive concept.
Figure 3B:
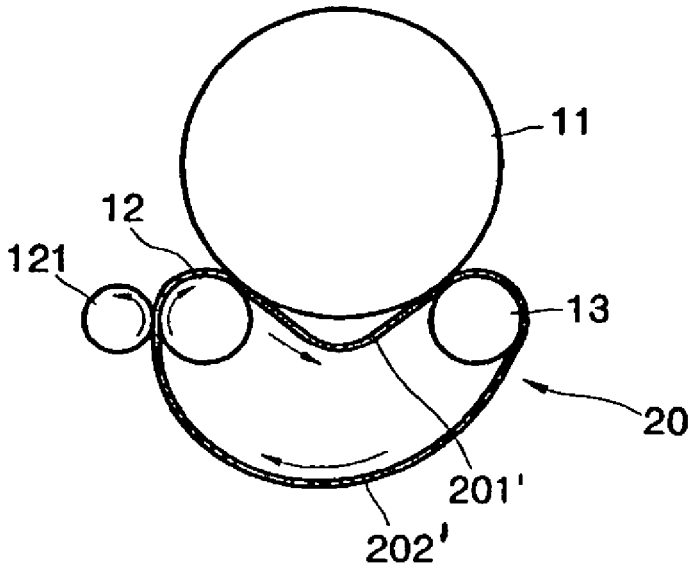

FIGS. 3A and 3B are views illustrating a driving method of the variable tension belt type fusing unit of FIG. 1. The variable tension belt type fusing unit and the driving method of FIGS. 3A and 3B are similar to the embodiment of FIGS. 2A and 2B. However, a pinch roller 121 to generate a friction force with the fusing belt 20 and the preceding roller 12 is further provided. The pinch roller 121 provided to be pressurized towards the preceding roller 12 may rotate together with the preceding roller 12, the fusing belt 20 is disposed therebetween, and the pinch roller 121 ensures a stable traveling of the fusing belt 20.

Figure 4A:
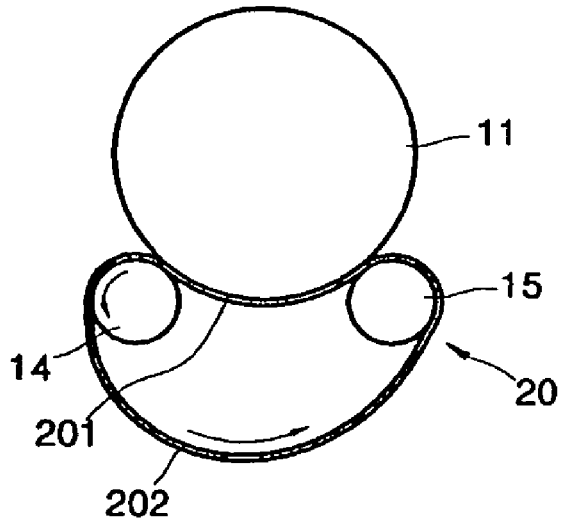
FIGS. 4A and 4B are views illustrating a driving method of a fusing unit according to another embodiment of the present general inventive concept.
Figure 4B:
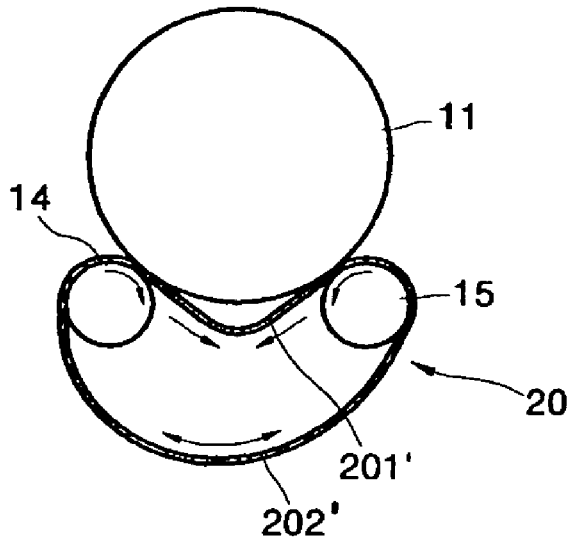

FIGS. 4A and 4B are views illustrating a driving method of the variable tension belt type fusing unit of FIG. 1. According to the present embodiment, when the variable tension belt type fusing unit completes the operation as illustrated in FIG. 4A, a preceding roller 14 reversely rotates while an accompanying roller 15 forwardly rotates, so that a nip portion 201 is loosened to form a non-nip portion 201' as illustrated in FIG. 4B. At this time, a length of the second non-tension portion 202' is shortened compared to that of the non-tension portion 202. However, the tension is not applied to the second non-tension portion 202' according to the reverse rotation of the preceding roller 14.

Figure 5A:
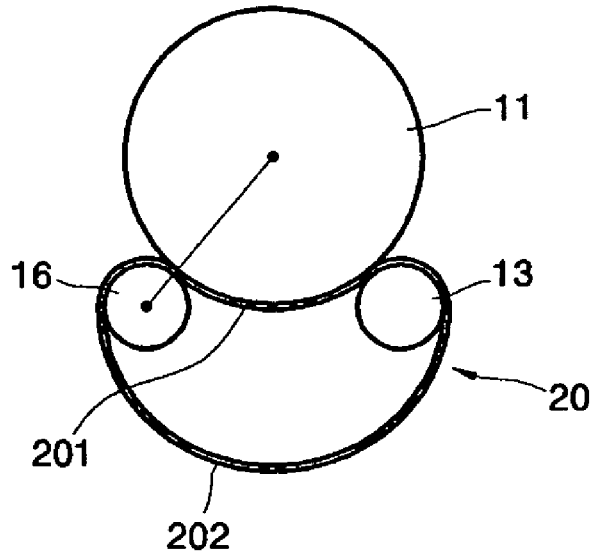
FIGS. 5A and 5B are views illustrating a driving method of the fusing unit of FIG. 1 according to yet another embodiment of the present general inventive concept.
Figure 5B:
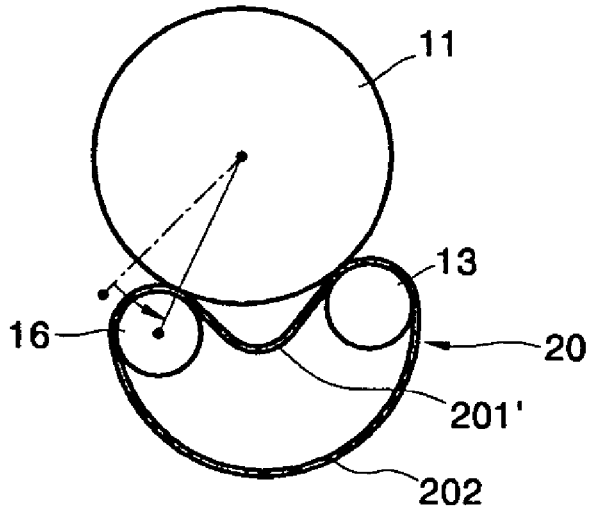

FIGS. 5A and 5B are views illustrating a driving method of a variable tension belt type fusing unit according to yet another embodiment of the present general inventive concept. According to the present embodiment, a preceding roller 16 is provided to be temporarily displaceable with respect to the accompanying roller 13 and the main roller 11. When the variable tension belt type fusing unit completes the operation, as illustrated in FIG. 5B, the preceding roller 16 may be moved towards the accompanying roller 13 along the outer circumferential surface of the main roller 11 to loosen the fusion belt 20 to form a non-nip section 201'.

Accordingly, in various embodiments of a variable tension belt type fusing unit usable with an image forming apparatus and a driving method thereof according to the present general inventive concept, a fusing belt is divided into a tension portion having a nip portion close to a main roller to fuse an image on a recording medium and a non-tension portion, a tension is applied to the fusing belt only within the tension portion in a printing operation mode, and the tension of the tension portion is released during a power saving mode which is a non-printing operation mode, so that the lifespan of the fusing belt increases. In addition, when the fusing belt is meandered or slipped, the tension is temporarily released and then is reapplied, thereby improving the stability of traveling of the fusing belt.

When the image forming apparatus is turned on and the variable tension belt type fusing unit is prepared for an operation, a pair of belt driving rollers is released from an engaging condition with a main roller and the pair of belt driving rollers apply a tension by pulling the nip section. When the tension is applied to the nip section of the fusing belt, the nip section is adhered towards the main roller by applying a predetermined pressure. During the operation of the variable tension belt type fusing unit, the pair of rollers and the main roller are engaged with each other and maintain the tension in the nip section. A paper on which a toner image is transferred is fed while being engaged to the nip section between the main roller and the fusing belt. At this time, the toner image transferred onto the paper is melt by the heat source, and the melted toner image is pressurized and adhered onto the paper by the pressure between the main roller and the fusing belt. When the operation of the variable tension belt type fusing unit is completed, the pair of belt driving rollers operates in an opposite way with respect to when the variable tension belt type fusing unit is prepared for the operation and thereby releases the tension in the nip section. Thus, the variable tension belt type fusing unit according to various embodiments of the present general inventive concept can minimize the time for applying the tension to the fusing belt, increase the lifespan of the fusing belt, and prevent problems of slipping or meandering caused by deformation of the fusing belt.

Figure 6:
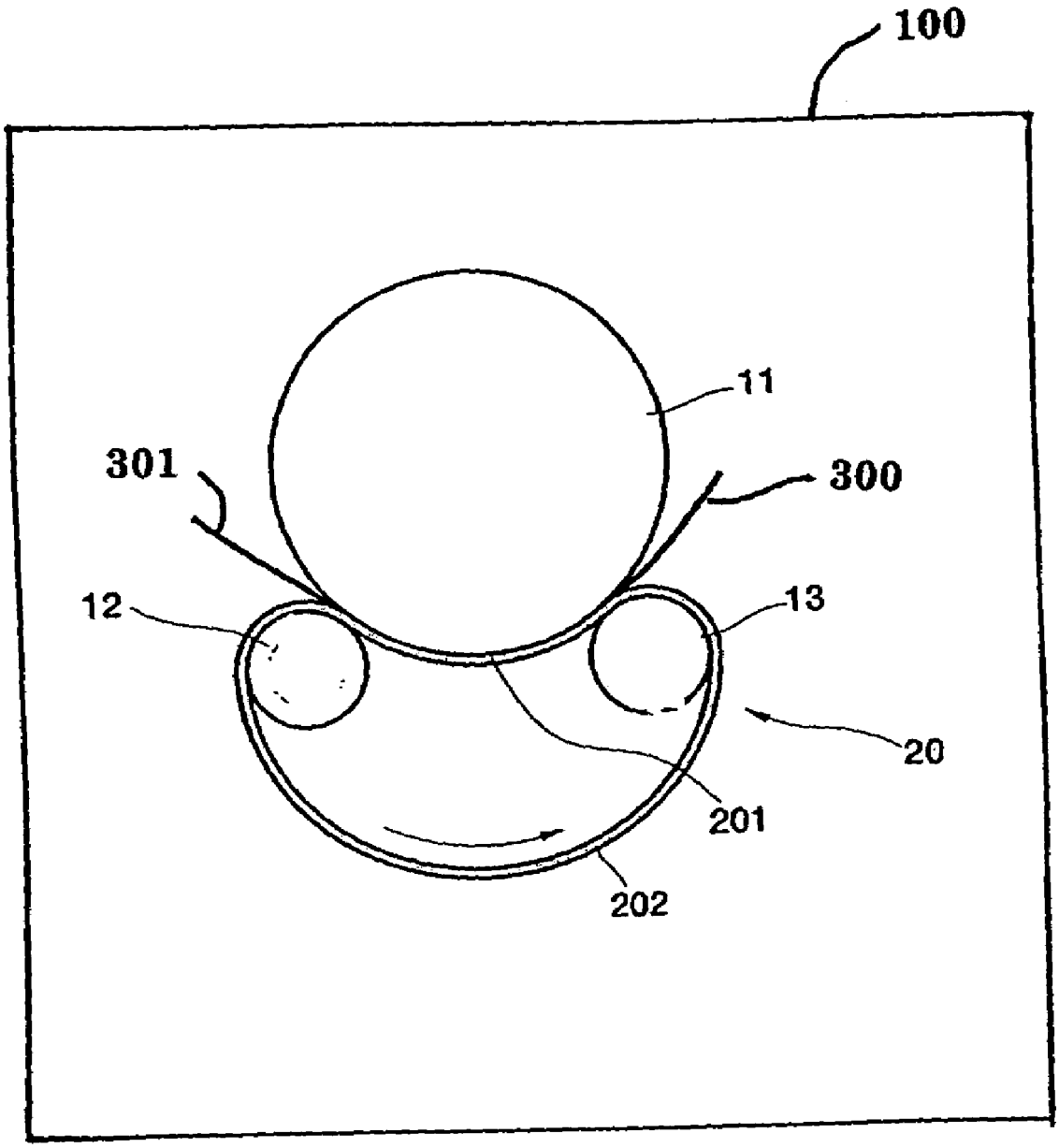
FIG. 6 is a view illustrating an image forming apparatus having a variable tension belt type fusing unit according to an embodiment of the present general inventive concept.

FIG. 6 is a view illustrating an image forming apparatus 100 having the variable tension belt type fusing unit of FIG. 1 according to an embodiment of the present general inventive concept. Referring to FIGS. 1 and 6, a sheet of paper 300 is fed through a nip between the main roller 11 and the nip portion 201 of the fusing belt 20. A toner image 301 on the sheet of paper 300 is fixed thereon due to heat and pressure applied while the sheet of paper 300 passes through the nip along the nip portion 201. The operations of the pair of belt driving rollers 12 and 13 are similar to the operations described in FIGS. 2-5B in order to control tension of the fusing belt 20 and a distance between the main roller 11 and the fusing belt 20.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A variable tension type belt fusing unit, comprising:

a main roller;

a pair of belt driving rollers which is disposed near an outer circumferential surface of the main roller and is pressurized towards the main roller; and a fusing belt to travel by the pair of belt driving rollers in a travel direction, and having a nip portion and a non-tension portion, the nip portion being adhered towards the main roller by applying a tension and disposed at one side of the pair of belt driving rollers, the non-tension portion provided at the other side of the pair of belt driving rollers, such that at least one of the pair of belt driving rollers is independently and temporarily driven to apply or release the tension to the nip portion, wherein the pair of belt driving rollers temporarily rotate in opposite directions to release the tension from the nip portion.

2. The variable tension type belt fusing unit according to claim 1, wherein at least one of the pair of belt driving rollers temporarily and relatively rotates with respect to the main roller to apply or release the tension in the nip portion.

3. The variable tension type belt fusing unit according to claim 2, wherein one of the pair of belt driving rollers comprises a preceding roller to temporarily and reversely rotate with respect to the main roller.

4. The variable tension type belt fusing unit according to claim 1, wherein at least one of the pair of belt driving rollers temporarily moves in a direction that narrows a distance between the pair of belt driving rollers.

5. The variable tension type belt fusing unit according to claim 1, further comprising:

a pinch roller engaged with one of the pair of belt driving rollers to drive the fusing belt.

6. A driving method of a variable tension type belt fusing unit including a main roller, a pair of belt driving rollers which is disposed near an outer circumferential surface of the main roller and is pressurized towards the main roller, and a fusing belt to travel between the pair of belt driving rollers and the main roller, the method comprising:

applying a tension to a nip portion of the fusing belt by the pair of belt driving rollers in a printing mode, maintaining the tension in the nip portion during the printing mode, while the fusing belt travels, and releasing the tension in the nip portion by the pair of belt driving rollers when the printing mode is completed or in a stand-by mode, wherein, the applying of the tension comprises independently rotating at least one of the pair of belt driving rollers in a direction away from the nip section when the variable tension type belt fusing unit is in the printing mode;

the maintaining of the tension comprises rotating the main roller and the pair of belt driving rollers to be engaged with each other to have a same travel speed at each surface facing each other during the printing mode and the releasing of the tension comprises independently rotating at least one of the pair of belt driving rollers towards the nip portion when the printing mode is completed.

7. The method according to claim 6, wherein the applying of the tension and the releasing of the tension comprise independently rotating only a preceding roller of the pair of belt driving rollers in the printing mode and the stand-by mode, respectively.

8. The method according to claim 6, wherein the applying of the tension and the releasing of the tension comprise simultaneously rotating the pair of belt driving rollers in opposite directions in the stand-by mode.

9. The method according to claim 6, wherein:

the applying of the tension comprises independently moving at least one of the pair of belt driving rollers in a direction that widens a distance between the pair of belt driving rollers in the printing mode;

the maintaining of the tension comprises rotating the main roller and the pair of belt driving rollers engaged with each other to have the same travel speed at each surface facing each other during the printing mode; and the releasing of the tension comprises moving at least one roller of the pair of belt driving rollers in a direction that narrows the distance between the pair of belt driving rollers when the printing mode is terminated.

10. An image forming apparatus, comprising:

a main roller;

a fusing belt; and a pair of belt driving rollers disposed inside the fusing belt to rotate the fusing belt to form a nip portion of the fusing belt between the pair of the belt driving rollers to face a portion of the main roller, one of the pair of belt driving rollers moving according to first and second manners with respect to the other one of the belt driving rollers such that tension is applied to or released from a nip portion of the fusing belt, wherein the one or the pair of belt driving rollers comprises a preceding roller, the other one of the belt driving rollers comprises an accompany roller, and the preceding roller rotates in a forward direction while the accompanying roller rotates according to a movement of the fusing belt in a traveling direction so that the tension is applied to the nip portion of the fusing belt, and wherein the preceding roller rotates in a reverse direction while the accompany roller does not rotate, so that the tension is released from the nip portion of the fusing belt.

11. The image forming apparatus according to claim 10, wherein the one of the pair of belt driving rollers rotates in forward and reverse directions according to first and second manners to apply or release the tension to or from the nip portion of the fusing belt.

12. The image forming apparatus according to claim 10, wherein the one of the pair of belt driving rollers moves away from and close to the other one of the pair of the belt driving rollers with respect to the main roller according to first and second manners to apply or release the tension to or from the nip portion of the fusing belt.

13. The image forming apparatus according to claim 10, wherein the pair of belt driving rollers moves opposite directions with respect to each other according to first and second manners to apply or release the tension to or from the nip portion of the fusing belt.

14. The image forming apparatus according to claim 10, wherein:

the preceding roller rotates in a reverse direction while the accompanying roller does not rotate;

the nip portion comprises a first portion disposed between the main roller and one of the preceding roller and the accompanying roller and spaced-apart from the main roller by a first distance, and a second portion disposed between the preceding roller and the accompanying roller and spaced-apart from the main roller by a second distance greater than the first distance when the preceding roller rotates in the reverse direction.

15. The image forming apparatus according to claim 14, wherein the second distance is substantially the same as the first distance when the preceding roller rotates in the forward direction.

16. The image forming apparatus according to claim 10, wherein:

the preceding roller rotates in a reverse direction while the accompanying roller does not rotate to release the tension from the nip portion of the fusing belt in a stand-by mode; and the nip portion is disposed between the preceding roller and the accompanying roller and detached from the portion of the main roller according to the reverse rotation of the preceding roller.

17. A belt fusing unit, comprising:

a main roller;

a fusing belt having a nip portion to face the main roller; and at least two belt driving rollers to rotate the fusing belt and to apply a tension to the nip portion of the fusing belt by rotating at least one of the at least two belt driving rollers in a first direction and to release the tension applied to the nip portion of the fusing belt by rotating at least one of the at least two belt driving rollers in a second direction.

18. The belt fusing unit of claim 17, wherein the nip portion has a first length when tension is applied by the at least two belt driving rollers and a second length greater than the first length when tension is released by the at least two belt driving rollers.

19. The belt fusing unit of claim 17, wherein the first direction corresponds to a print mode, and the second direction corresponds to a stand-by mode.

20. A method of driving a belt fusing unit including a main roller, a fusing belt having a nip portion to face the main roller, and at least two belt driving rollers to rotate the fusing belt, the method comprising:

driving at least one of the at least two belt driving rollers in a first direction to apply a tension to the nip portion; and driving at least one of the at least two belt driving rollers in a second direction to release the tension applied to the nip portion.

21. The method of claim 18, wherein the first direction corresponds to a print mode, and the second direction corresponds to a stand by mode.

* * * * *